US011352113B2

(12) United States Patent
Vasilenko

(10) Patent No.: US 11,352,113 B2
(45) Date of Patent: Jun. 7, 2022

(54) COLLAPSIBLE BLADE EQUIPPED PADDLE DEVICE

(71) Applicant: Vyacheslav Vasilenko, Clinton, UT (US)

(72) Inventor: Vyacheslav Vasilenko, Clinton, UT (US)

( * ) Notice: Subject to any disclaimer, the term of this patent is extended or adjusted under 35 U.S.C. 154(b) by 0 days.

(21) Appl. No.: 17/082,196

(22) Filed: Oct. 28, 2020

(65) Prior Publication Data

US 2022/0126962 A1 Apr. 28, 2022

(51) Int. Cl.
*B63H 16/04* (2006.01)
*B63B 34/26* (2020.01)

(52) U.S. Cl.
CPC ..... *B63H 16/04* (2013.01); *B63B 34/26* (2020.02)

(58) Field of Classification Search
CPC ..... B63H 16/04; B63B 34/26
See application file for complete search history.

(56) References Cited

U.S. PATENT DOCUMENTS 427,842 A 5/1890 Dice
1,066,662 A * 7/1913 Schmidt ..... B63H 16/04 416/74
1,555,097 A * 9/1925 Beebe ..... B63H 16/102 440/103
1,805,749 A * 5/1931 Zoglauer ..... B63H 16/04 416/74
3,037,219 A * 6/1962 Webb ..... B63H 16/04 416/240
3,135,977 A * 6/1964 Vidal ..... B63H 16/04 416/74
4,622,017 A 11/1986 McGraw
5,041,037 A * 8/1991 Jaw ..... B63H 16/04 440/102
7,922,549 B1 * 4/2011 Sirota ..... B63H 1/32 440/20
2005/0101200 A1 * 5/2005 Townsend ..... B63H 16/04 440/101
2015/0125296 A1 * 5/2015 Swanson ..... B63H 16/04 416/5

* cited by examiner

*Primary Examiner* — S. Joseph Morano
*Assistant Examiner* — Jovon E Hayes

(57) ABSTRACT

A collapsible blade equipped paddle device enabling an underwater return stroke includes a shaft, which has a blade engaged to a first end thereof. The blade comprises a frame having a panel engaged thereto and extending therebetween. The frame is selectively collapsible so that the blade assumes an open cupped configuration when a forward stroke is applied to the shaft and a collapsed configuration when an underwater return stroke is applied to the shaft. The blade provides thrust to a marine vessel during the forward stroke and minimal resistance during the underwater return stroke.

8 Claims, 4 Drawing Sheets

COLLAPSIBLE BLADE EQUIPPED PADDLE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to paddle devices and more particularly pertains to a new paddle device enabling an underwater return stroke.

(2) Description of Related Art Including Information Disclosed Under 37 CFR 1.97 and 1.98

The prior art relates to paddle device. Prior art paddle devices may comprise a rigid blades hingedly engaged to a shaft, a two-element rigid blade wherein both elements are hingedly engaged to a shaft, and a collapsible blade that is not cup forming during a forward stroke. What is lacking in the prior art is a paddle device having a blade that is cup forming during a forward stroke and collapsible during a return stroke.

BRIEF SUMMARY OF THE INVENTION

An embodiment of the disclosure meets the needs presented above by generally comprising a shaft, which has a blade engaged to a first end thereof. The blade comprises a frame having a panel engaged thereto and extending therebetween. The frame is selectively collapsible so that the blade assumes an open cupped configuration when a forward stroke is applied to the shaft and a collapsed configuration when an underwater return stroke is applied to the shaft. The blade is configured to provide thrust to a marine vessel during the forward stroke and minimal resistance during the underwater return stroke.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
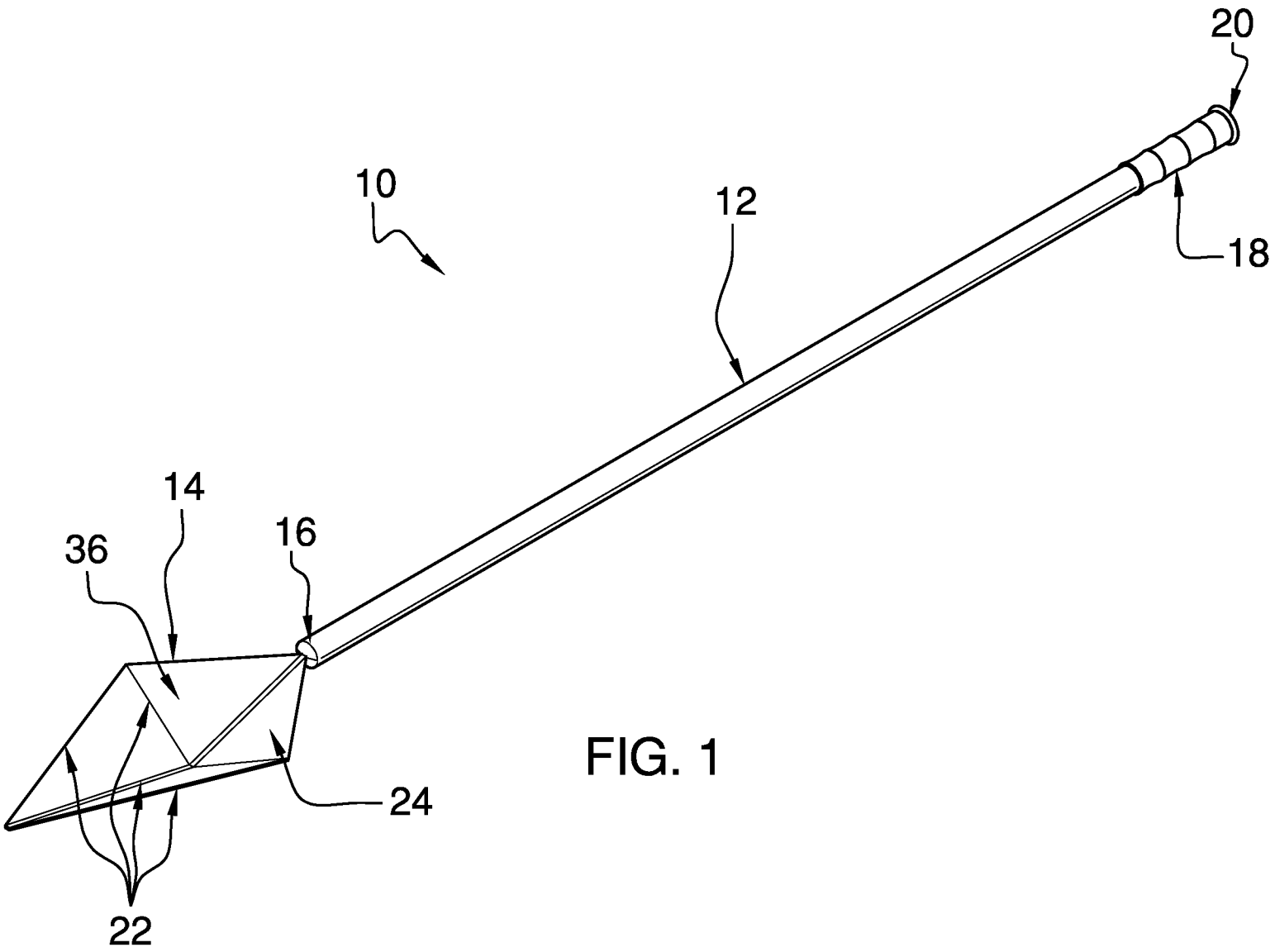
FIG. 1 is an isometric perspective view of a collapsible blade equipped paddle device according to an embodiment of the disclosure.

With reference now to the drawings, and in particular to FIGS. 1 through 6 thereof, a new paddle device embodying the principles and concepts of an embodiment of the disclosure and generally designated by the reference numeral 10 will be described.

As best illustrated in FIGS. 1 through 5, the collapsible blade equipped paddle device 10 generally comprises a shaft 12, which has a blade 14 engaged to a first end 16 thereof. The shaft 12 may be cylindrical, as shown in FIG. 1. The present invention also anticipates the shaft 12 having an oval or rectangular cross-sectional profile (not shown). The shaft 12 may be solid or hollow and may comprise a plurality of nested sections (not shown) so that the shaft 12 is selectively extensible. A grip 18 is engaged to the shaft 12 proximate to a second end 20 thereof.

Figure 2:
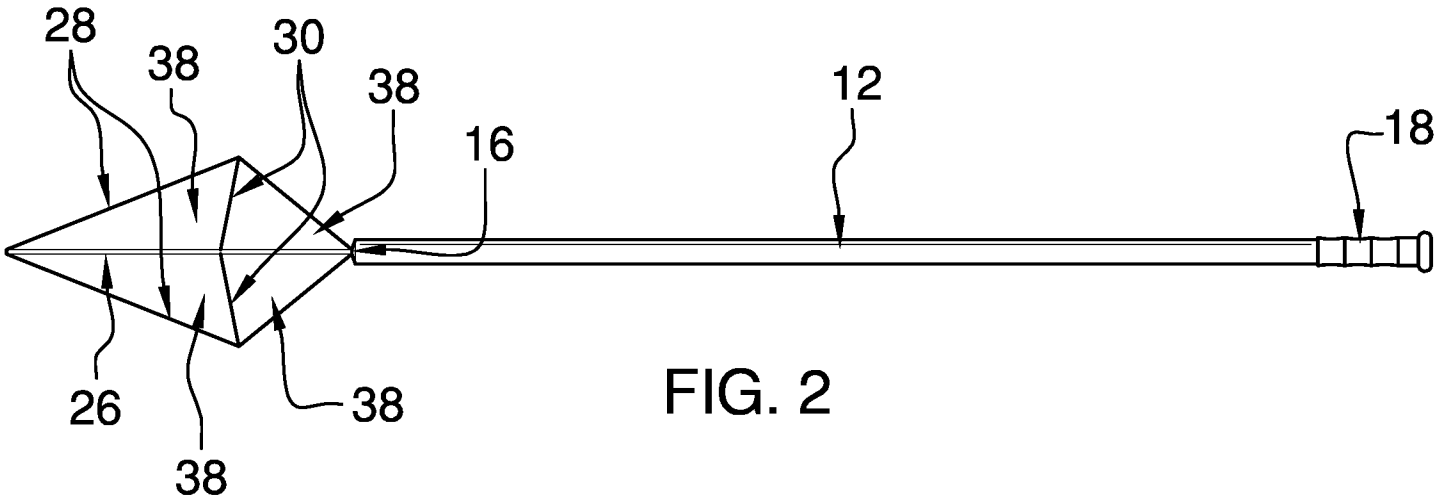
FIG. 2 is a front view of an embodiment of the disclosure.
Figure 3:
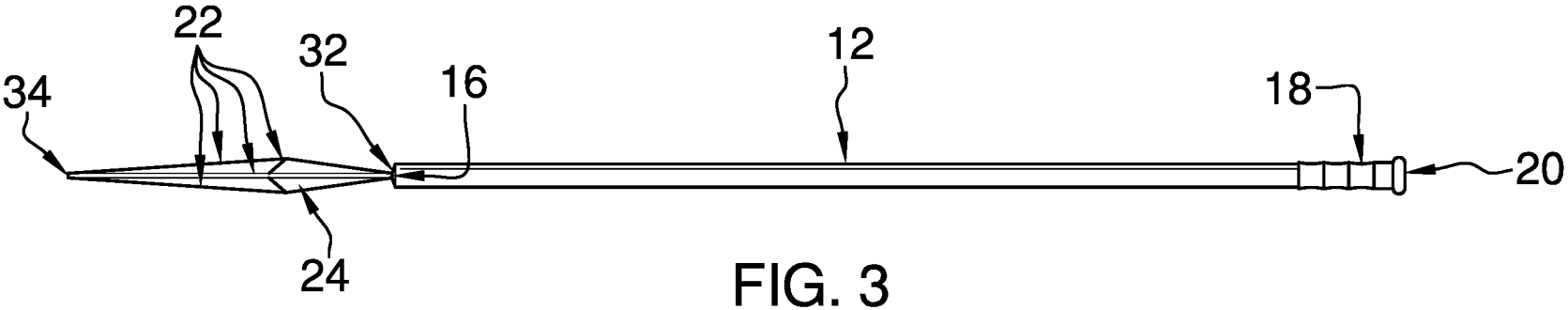
FIG. 3 is a back view of an embodiment of the disclosure.

The blade 14 comprises a frame 22 having a panel 24 engaged thereto and extending therebetween. The panel 24 comprises rubber, silicone, or elastomer. The frame 22 is selectively collapsible so that the blade 14 assumes an open cupped configuration, as shown in FIG. 2, when a forward stroke is applied to the shaft 12 and a collapsed configuration, as shown in FIG. 3, when an underwater return stroke is applied to the shaft 12. The blade 14 is configured to provide thrust to a marine vessel during the forward stroke and minimal resistance during the underwater return stroke.

Figure 4:
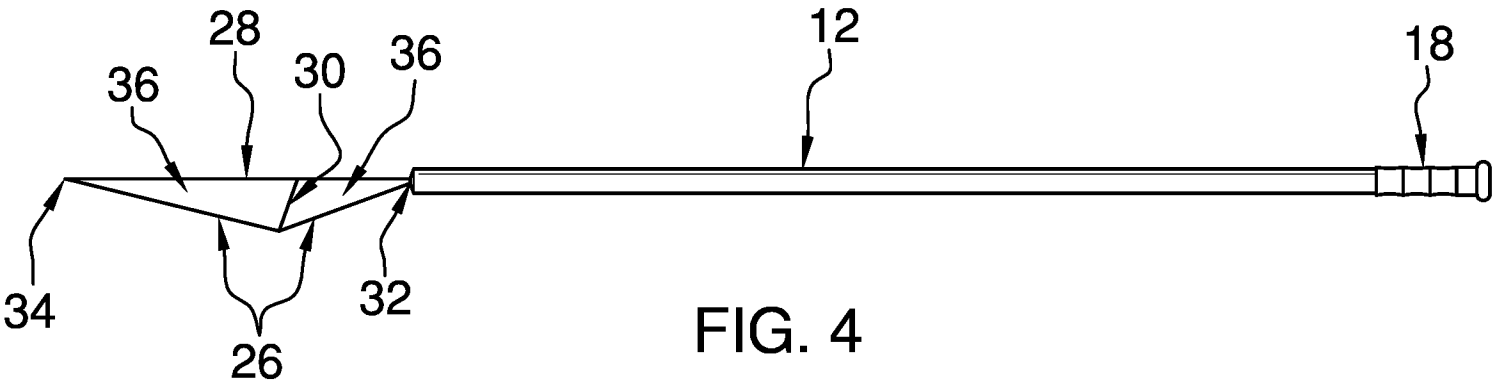
FIG. 4 is a side view of an embodiment of the disclosure.
Figure 5:
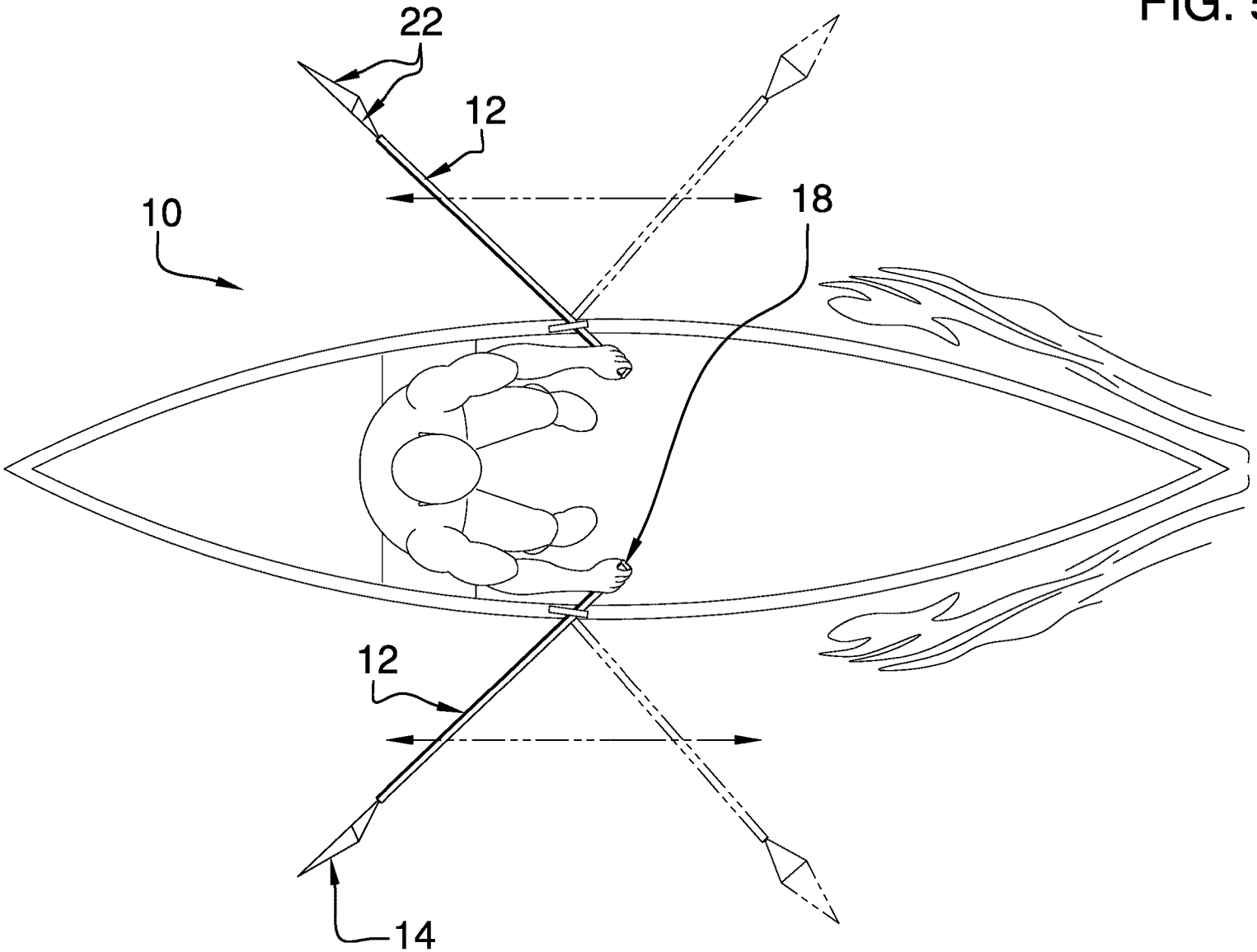
FIG. 5 is an in-use view of an embodiment of the disclosure.

The frame 22 comprises a first rod 26, a pair of second rods 28, and a pair of crossbeams 30. The first rod 26 is engaged by a first terminus 32 to the first end 16 the shaft 12 and extends therefrom. The first rod 26 is angled or curved. The first rod 26 may extend transversely from the shaft 12, as shown in FIG. 4, although the present invention also anticipates the first rod 26 extending linearly from the shaft 12.

Each second rod 28 is angled or curved and is pivotally engaged to and extends between the first terminus 32 and a second terminus 34 of the first rod 26. As shown in FIG. 2, the pair of second rods 28 define a field 36. The panel 24 is engaged to the pair of second rods 28 and extends over the field 36.

Each crossbeam 30 is pivotally engaged to and extends between a respective second rod 28 and the first rod 26. With the first rod 26 and the second rods 28 being angled, as shown in FIG. 1, the frame 22 defines four sections 38 of the panel 24. Each section 38 is triangularly shaped so that the blade 14 is substantially kite shaped in the open cupped configuration.

In use, the device 10 can be employed by a user to propel a rowboat, canoe, kayak, or the like. During a forward stroke, the blade 14 assumes the open cupped configuration and provides thrust to the marine vessel. The device 10 enables an underwater return stroke having minimal resistance due to the frame 22 assuming the collapsed configuration. The device 10 provides an easier to perform alternative to what is called an Indian Stroke, wherein a standard paddle is rotated 90 degrees at the end of a forward stroke and prior to performing an underwater return stroke.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A collapsible blade equipped paddle device comprising:

a shaft; and a blade engaged to a first end of the shaft, the blade comprising a frame having a panel engaged thereto and extending therebetween, the frame being selectively collapsible, such that the blade assumes an open cupped configuration when a forward stroke is applied to the shaft, and a collapsed configuration when an underwater return stroke is applied to the shaft, wherein the blade is configured for providing thrust to a marine vessel during the forward stroke and minimal resistance during the underwater return stroke; and wherein the frame comprises a first rod engaged by a first terminus to the first end the shaft and extending, therefrom, the first rod being angled or curved, and a pair of second rods, each second rod being angled or curved, each second rod being pivotally engaged to and extending between the first terminus and a second terminus of the first rod, such that the pair of second rods defines a field, the panel being engaged to the pair of second rods and extending over the field.

2. The collapsible equipped paddle device of claim 1, wherein the shaft is cylindrical.

3. The collapsible blade equipped paddle device of claim 1, wherein the panel comprises rubber, silicone, or elastomer.

4. The collapsible blade equipped paddle device of claim 1, wherein the first rod extends transversely from the shaft.

5. The collapsible blade equipped paddle device of claim 1, further including the frame comprising a pair of crossbeams, each crossbeam being pivotally engaged to and extending between a respective second rod and the first rod.

6. The collapsible blade equipped paddle device of claim 1, further including:

the frame comprising a pair of crossbeams, each crossbeam being pivotally engaged to and extending between a respective second rod and the first rod; and the first rod and the second rods being angled, such that the frame defines four sections of the panel, each section being triangularly shaped, such that the blade is substantially kite shaped in the open cupped configuration.

7. The collapsible blade equipped paddle device of claim 1, further including a grip engaged to the shaft proximate to a second end thereof.

8. A collapsible blade equipped paddle device comprising:

a shaft, the shaft being cylindrical;

a blade engaged to a first end of the shaft, the blade comprising a frame having a panel engaged thereto and extending therebetween, the frame being selectively collapsible, such that the blade assumes an open cupped configuration when a forward stroke is applied to the shaft, and a collapsed configuration when an underwater return stroke is applied to the shaft, wherein the blade is configured for providing thrust to a marine vessel during the forward stroke and minimal resistance during the underwater return stroke, the panel comprising rubber, silicone, or elastomer the frame comprising:

a first rod engaged by a first terminus to the first end the shaft and extending therefrom, the first rod being angled the first rod extending transversely from the shaft, a pair of second rods, each second rod being angled, each second rod being pivotally engaged to and extending between the first terminus and a second terminus of the first rod, such that the pair of second rods defines a field, the panel being engaged to the pair of second rods and extending over the field, and a pair of crossbeams, each crossbeam being pivotally engaged to and extending between a respective second rod and the first rod, such that the frame defines four sections of the panel, each section being triangularly shaped, such that the blade is substantially kite shaped in the open cupped configuration; and a grip gaged to the shaft proximate to a second end thereof.

* * * * *